US006430848B1

(12) United States Patent
Susman et al.

(10) Patent No.: US 6,430,848 B1
(45) Date of Patent: Aug. 13, 2002

(54) UNDERWATER EXCAVATION APPARATUS

(75) Inventors: Hector Filippus Alexander Van Drentham Susman; Kenneth Roderick Stewart, both of Aberdeen (GB)

(73) Assignee: Rotech Holdings Limited, Aberdeen (GB)

( * ) Notice: Subject to any disclaimer, the term of this patent is extended or adjusted under 35 U.S.C. 154(b) by 0 days.

(21) Appl. No.: 09/331,151

(22) PCT Filed: Dec. 19, 1996

(86) PCT No.: PCT/GB96/03148

§ 371 (c)(1),
(2), (4) Date: Aug. 12, 1999

(87) PCT Pub. No.: WO98/27286

PCT Pub. Date: Jun. 25, 1998

(51) Int. Cl.[7] ..... E02F 3/88
(52) U.S. Cl. ..... 37/195; 37/323
(58) Field of Search ..... 37/317, 323, 327, 37/195, 331, 330, 343, 307; 405/73, 163, 226; 415/199.9, 80, 81; 416/124, 128, 129

(56) References Cited

U.S. PATENT DOCUMENTS

| | | | | |
|---|---|---|---|---|
| 3,235,232 A | * | 2/1966 | Conover | 172/323 |
| 4,914,841 A | | 4/1990 | Weinrib | |
| 4,957,392 A | | 9/1990 | Bailard | |
| 5,607,289 A | * | 3/1997 | Sills | 417/375 |
| 5,833,444 A | * | 11/1998 | Harris et al. | 418/113 |
| 6,022,173 A | * | 2/2000 | Saxon | 405/163 |
| 6,053,663 A | * | 4/2000 | Dikken et al. | 405/163 |

FOREIGN PATENT DOCUMENTS

| | | |
|---|---|---|
| EP | 0 328 198 | 8/1989 |
| GB | 2 240 568 | 8/1991 |
| GB | 2 297 777 | 8/1996 |
| GB | 2 302 348 | 1/1997 |

* cited by examiner

*Primary Examiner*—Robert E. Pezzuto
(74) *Attorney, Agent, or Firm*—Jacobson Holman, PLLC

(57) ABSTRACT

An improved underwater excavation apparatus achieves efficiency and control of movement through provision of a hollow body having at least one inlet and at least one outlet, at least one pair of impellers coaxially displaced one from the other and rotatably mounted in the hollow body, and a mechanism for driving the impellers in contrary rotating directions. The underwater excavation apparatus comprises a pair of horizontally opposed inlets communicating with a single outlet, the outlet being disposed vertically downwards substantially midway between the two inlets, in use. The excavation apparatus may, therefore, be substantially "T" or "Y" shaped. The mechanism for driving the impellers may include at least one drilling motor.

41 Claims, 6 Drawing Sheets

UNDERWATER EXCAVATION APPARATUS

BACKGROUND OF THE INVENTION

This invention relates to an improved excavation apparatus, and in particular to an improved underwater excavation apparatus.

Underwater excavation apparatus are known, eg, from GB 2 240 568 (CONSORTIUM RESOURCE et al). In that disclosure there is described. an underwater excavation apparatus comprising a hollow body with an inlet to receive water and an outlet for discharge of water. A propeller is rotatably mounted in the hollow body to draw water through the inlet and deliver a flow 6f water through the outlet. Water jets on the propeller tips rotate the propeller when water is supplied to the jets.

Such rotation causes water to be drawn into the body through the inlet and expelled from the body as a flow through the outlet. The flow can be used to displace material on the seabed.

Known prior art underwater excavation apparatus suffer from a number of problems/disadvantages, for example:

(a) Low energy efficiency due to e.g. hydrodynamic limitations of fluid jets, thus requiring extremely large and power hungry pumps to drive the system);

(b) tendency of apparatus to rotate in reaction to rotation of the propeller;

(c) difficulty in steering and positioning of the apparatus.

SUMMARY OF THE INVENTION

It is an object of at least some of the aspects of the present invention to seek to obviate or mitigate one or more of the aforementioned problems in the prior art.

According to a first aspect of the present invention there is provided an underwater excavation apparatus comprising a hollow body having at least one inlet and at least one outlet, at least one pair of impellers rotatably mounted in the hollow body and means for driving the impellers.

Advantageously, the driving means cause the impellers to be driven in contrary rotating directions, in use.

The at least one inlet may be inclined at an angle to an axis along which the at least one outlet is provided.

Preferably, there is provided at least one pair of inlets.

Preferably, the at least one pair of inlets are substantially symmetrically disposed around an axis extending from the outlet.

In one embodiment the underwater excavation apparatus comprises a pair of horizontally opposed inlets communicating with a single outlet, the outlet being disposed vertically downwards substantially midway between the two inlets, in use. In this case, the excavation apparatus is, therefore, substantially "T" shaped in profile.

In an alternative embodiment the underwater excavation apparatus comprises a pair of inlets communicating with a single outlet, the inlets being substantially symmetrically disposed around an axis extending from the outlet, the outlet being disposed vertically downwards substantially midway between the two inlets, in use. In this case, the excavation apparatus is, therefore, substantially "Y" shaped in profile.

Advantageously, the outlets are each spaced/inclined substantially 45° from the axis extending from the outlet.

At least one impeller may be provided within/adjacent each inlet.

The means for driving the/each impeller(s) may include at least one drilling motor.

The at least one drilling motor may comprise a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

Although not essential it is highly desirable that the rotor be provided with a seal for engagement with the stator.

Preferably, the seal is made from a material selected from the group consisting of plastics materials, polyethylethylketone, metal, copper alloys and stainless steel.

Advantageously, the rod is made from a material selected from the group consisting of plastics materials, polyethylethylketone, metal, copper alloys and stainless steel.

Preferably, the stator is provided with two rod recesses which are disposed opposite one another, and two exhaust ports which are disposed opposite one another, each of the rod recesses being provided with a respective rod, the rotor having two seals which are disposed opposite one another.

The drilling motor may advantageously comprise two drilling motors arranged with their respective rotors connected together each motor comprising a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

Preferably, the drilling motors are connected in parallel, although they could be connected in series if desired.

Advantageously, the drilling motors are arranged so that, in use, one drilling motor operates out of phase with the other. Thus, in a preferred embodiment each drilling motor has two chambers and the chambers in the first drilling motor are 90° out of phase with the chambers in the second drilling motor. Similarly, in an embodiment in which each drilling motor has four chambers, the chambers in the first drilling motor would preferably be 45° out of phase with the chambers on the second drilling motor. This arrangement helps ensure a smooth power output and inhibits stalling.

Alternatively, the at least one drilling motor may be a "Moineau", hydraulic or a suitably adapted electric motor.

The impellers may be driven by means of a gearbox or by exploitation of the opposing reactive torque on a drive body of the motor.

When the reactive torque upon the motor body is utilised, at least one impeller may be connected to an output shaft of said motor, while at least one other impeller may be connected to the motor body.

Alternatively the impellers may be driven by a pair of motors operating in opposite directions. In such case said motors and impellers are balanced and equal.

The underwater excavation apparatus may further comprise an agitator device having mechanical disturbance means and fluid flow disturbance means.

The underwater excavation apparatus may, in use, be suspended from a surface vessel or mounted upon a sled of the type currently known for use in subsea excavation operations.

According to a second aspect of the present invention there is provided an underwater apparatus comprising a hollow body having a pair of inlets communicating with an outlet, at least one pair of impellers rotatably mounted in the hollow body and means for driving the impellers, the inlets being substantially symmetrically disposed around an axis extending from the outlet, wherein the inlets are not horizontally opposed to one another.

BRIEF DESCRIPTION OF THE DRAWINGS

Embodiments of the present invention will now be described, by way of example only, with reference to the accompanying drawings, in which.

DETAILED DESCRIPTION OF INVENTION

Figure 1:
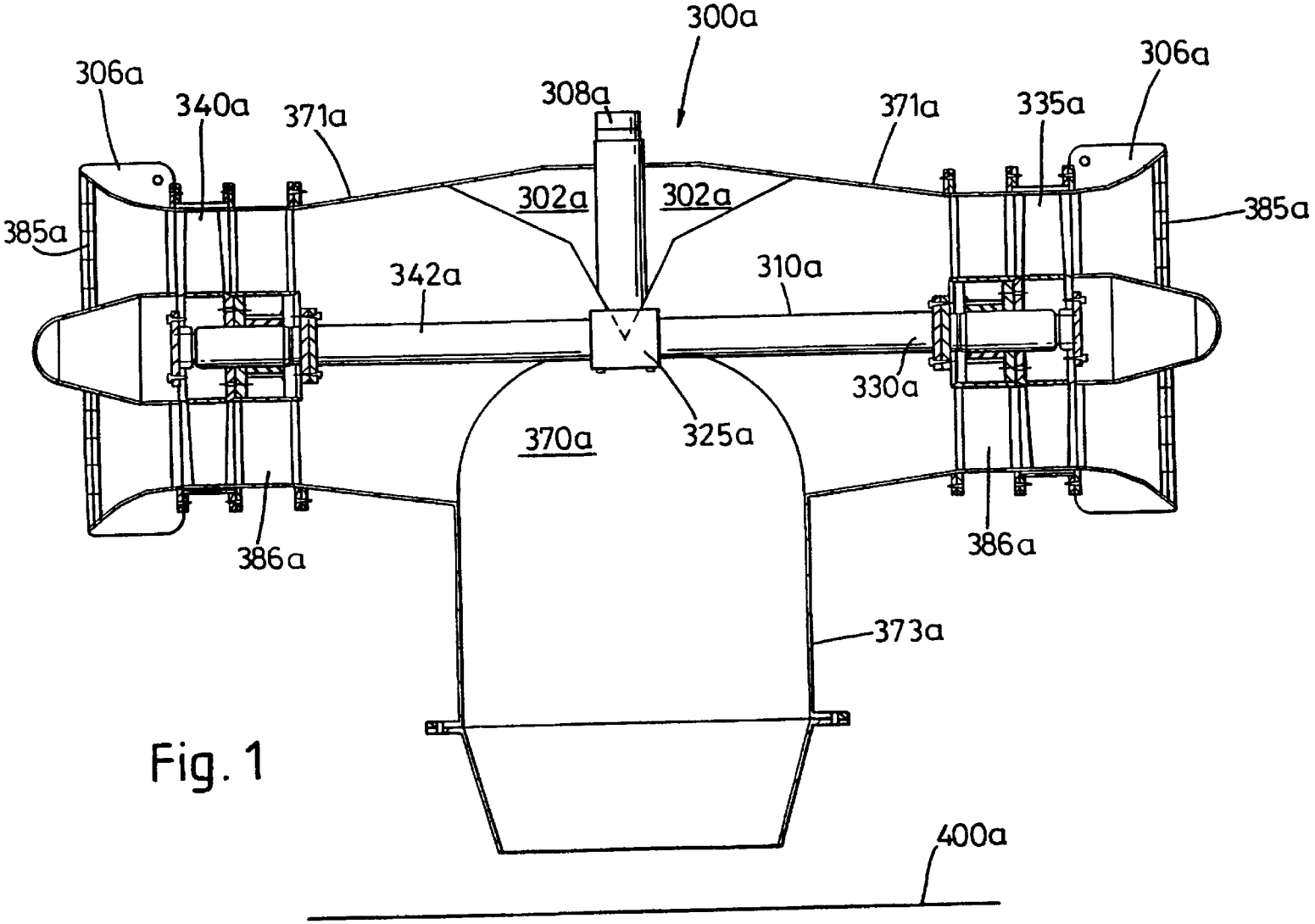
FIG. 1 shows a cross-sectional side view of a first embodiment of an excavation apparatus according to the present invention.

Referring to FIG. 1, there is shown a first embodiment of an underwater excavation apparatus 300*a* according to the present invention. The apparatus 300*a* comprises a hollow body 370*a* formed from a pair of horizontally opposed inlet ducts 371*a* and an outlet duct 373*a*, a drive motor 310*a* and a pair of impellers 335*a*, 340*a*.

The apparatus 300*a* is further provided with deflection baffles 302*a* within the hollow body 370*a*, suspension brackets 306*a* to enable the apparatus 300*a* to be suspended from a surface vessel, guide vanes 386*a* to regulate the flow of fluid past the impellers 335*a*, 340*a*, and safety grids 385*a* to seek to prevent the ingress of solid matter which may damage the impellers 335*a*, 340*a*.

In this first embodiment, the drive motor 310*a* is provided along an axis common to the horizontally opposed inlet ducts 371*a* and impellers 335*a*, 340*a*. An output shaft 330*a* of the motor 310*a* is connected to a first impeller 335*a* while the second impeller 340*a* is attached to a shaft 342*a* connected via a swivel 325*a* to an outer housing of the drive motor 310*a*.

In use, motive fluid is supplied to the motor 310*a* via fluid inlet 308*a* which in turn causes the output shaft 330*a* and impeller 335*a* to rotate. Reactive torque from this rotation causes the outer housing of the drive motor 310*a* to rotate in a direction opposite to that of the output shaft 330*a*. This in turn results in the rotation of the second impeller 340*a*. The impellers 335*a*, 340*a* are configured such that, despite rotating in opposite directions, they each provide an equal flow rate of water into the hollow body 370*a*. Water drawn into the hollow body 370*a* thus is directed via the deflection baffles 302*a* through the outlet duct 373*a* and towards the seabed 400*a*.

The shaft 342*a* and swivel 325*a* may, in an alternative embodiment, be replaced by a second motor which directly drives the impeller 340*a*, as hereinbefore described with reference to FIG. 5.

The excavation device 300*a* may be suspended, for example, from the bow or stern of a surface vessel, or through a moonpool of a dedicated subsea operations vessel.

In an alternative embodiment the device 300*a* may be provided upon a sled (not shown) of the type currently used for subsea operations. The excavation apparatus 300*a* may further be provided with an agitator device (not shown) having mechanical disturbance means and fluid flow disturbance means.

In an advantageous embodiment the motor 310 comprises a drilling motor, such as that disclosed in WO95/19488, the content of which is incorporated herein by reference.

The drilling motor 310 may comprise a first motor 20 and a second motor 50.

The first motor 20 comprises a stator 21 and a rotor 23. A top portion 22 of the rotor 23 extends through an upper bearing assembly 24 which comprises a thrust bearing 26 and seals 25.

Motive fluid, e.g. water, drilling mud or gas under pressure, flows down through a central sub channel 12 into a central rotor channel 27, and then out through rotor flow channels 28 into action chambers 31 and 32.

Following a motor power stroke, the motive fluid flows through exhaust ports 33 in stator 21, and then downwardly through an annular channel circumjacent the stator 21 and flow channels 35 in a lower bearing assembly 34. A portion 36 of the rotor 23 extends through the lower bearing assembly 34 which comprises a thrust bearing 37 and seals 38.

The ends of the stator 21 are castellated and the castellations engage in recesses in the respective upper bearing assembly 24 and lower bearing assembly 34 respectively to inhibit rotation of the stator 21. The upper bearing assembly 24 and lower bearing assembly 34 are a tight fit in an outer tubular member 14 and are held against rotation by compression between threaded sleeves 16 and 84.

A splined union 39 joins a splined end of the rotor 23 to a splined end of a rotor 53 of the second motor 50. The second motor 50 has a stator 51.

A top portion 52 of the rotor 53 extends through an upper bearing assembly 54. Seals 55 are disposed between the upper bearing assembly 54 and the exterior of the top portion 52 of the rotor 53. The rotor 53 moves on thrust bearings 56 with respect to the upper bearing assembly 54.

Motive fluid flows into a central rotor channel 57 from the central rotor channel 27 and then out through rotor flow channels 58 into action chambers 61 and 62. Following a motor power stroke, the motive fluid flows through exhaust ports 63 in stator 51, and then downwardly through an annular channel circumjacent the stator 51 and flow channels 65 in a lower bearing assembly 64. A portion 66 of the rotor 53 extends through a lower bearing assembly 64. The rotor 53 moves on thrust bearings 67 with respect to the lower bearing assembly 64 and seals 68 seal the rotor-bearing assembly interface. Also motive fluid which flowed through the flow channels 35 in the lower bearing assembly 34, flows downwardly through channels 79 in the upper bearing assembly 54, past stator 51 and through flow channels 65 in the lower bearing assembly 64.

The upper bearing assembly 54 and lower bearing assembly 64 are a tight fit in an outer tubular member 18 and are held against rotation by compression between threaded sleeve 84 and a lower threaded sleeve (not shown).

Figure 2:
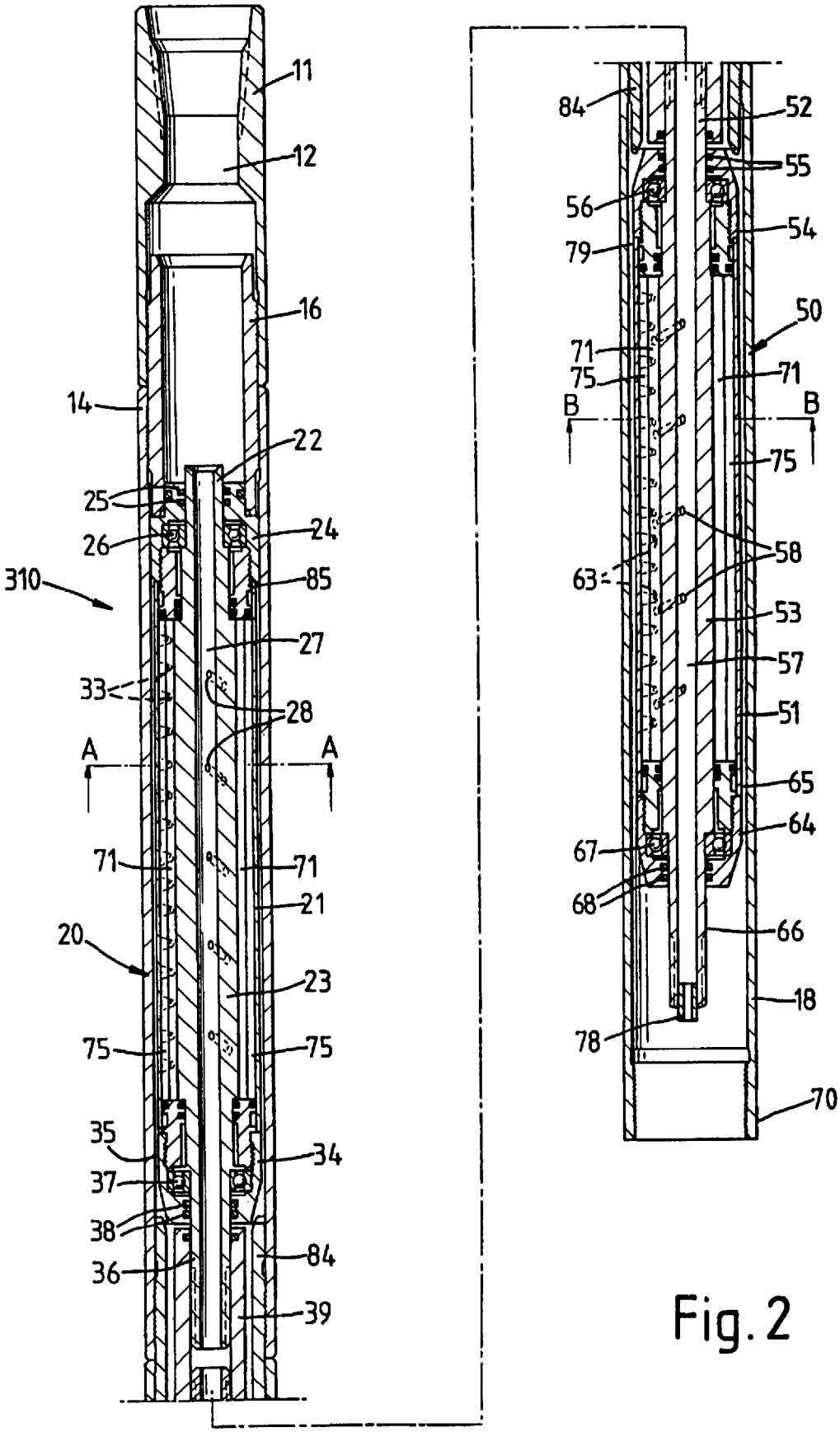
FIG. 2 shows a longitudinal cross-sectional view of one embodiment of a drilling apparatus for use in the excavation apparatus in FIG. 1 according to the present invention.
Figure 3A:
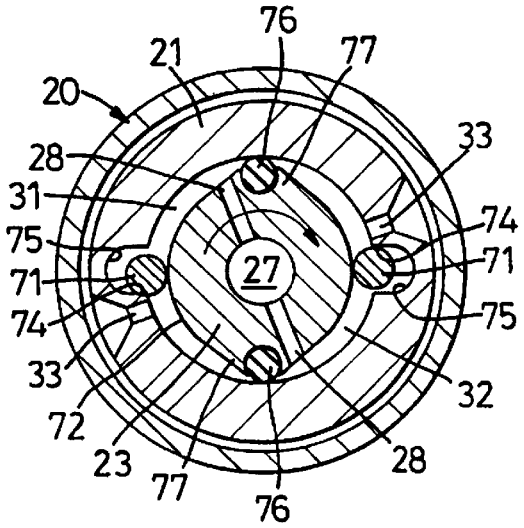
FIGS. 3A–3D are cross-sectional views along line A—A of FIG. 2 showing a rotor of the motor in four different positions.
Figure 3B:
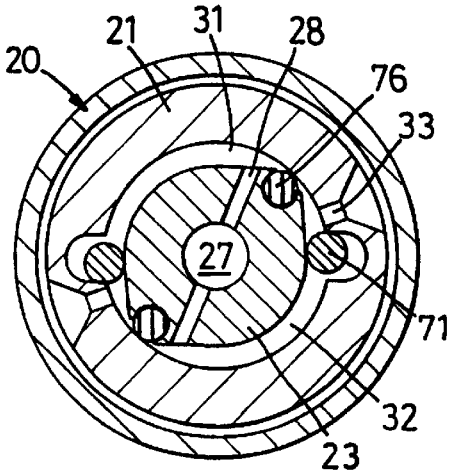
Figure 3C:
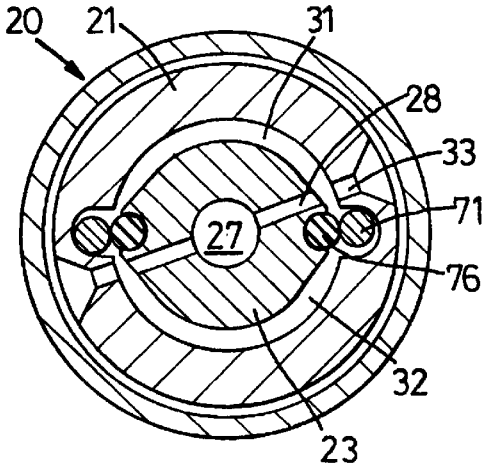
Figure 3D:
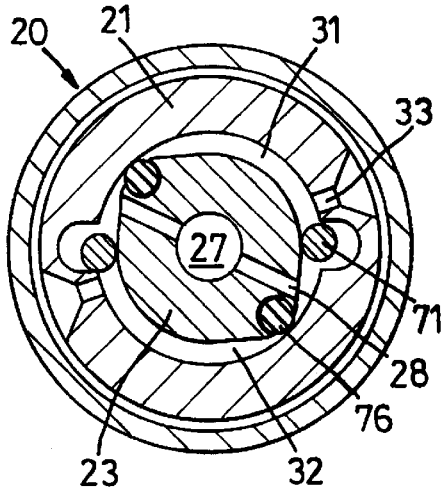
Figure 4A:
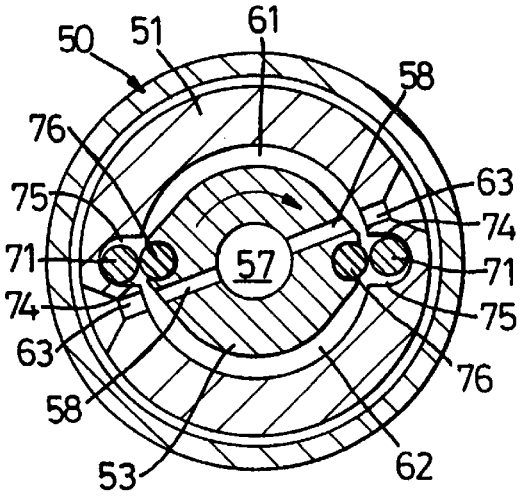
FIGS. 4A–4D are cross-sectional views along line B—B of FIG. 2 showing the rotor in four different positions.
Figure 4B:
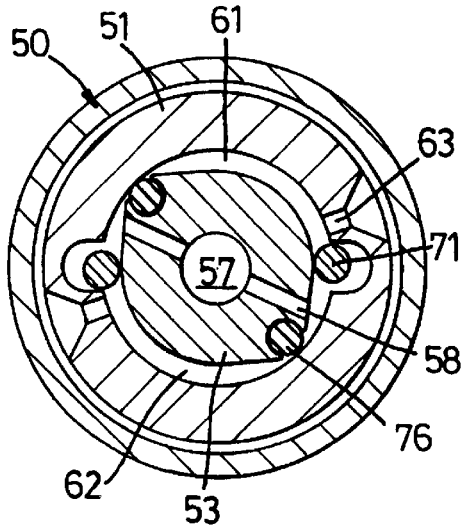
Figure 4C:
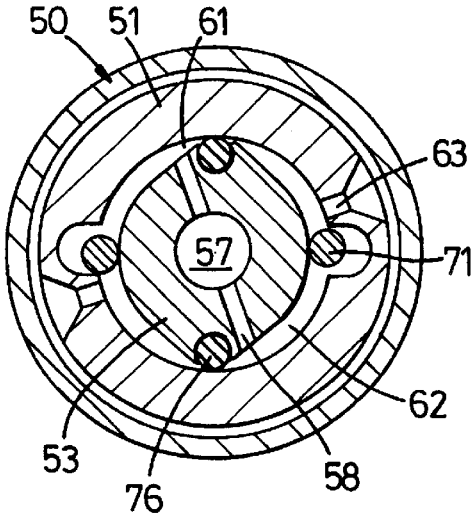
Figure 4D:
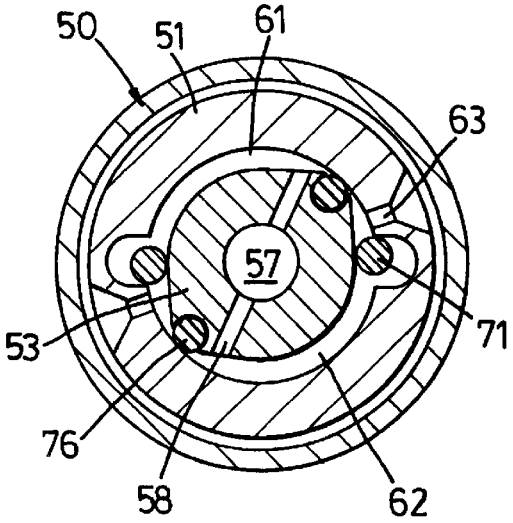

FIGS. 2A–2D and 3A–3D depict a typical cycle for the first and second motors 20 and 50 respectively, and show the status of the two motors with respect to each other at various times in the cycle. For example, FIG. 2C shows an exhaust period for the first motor 20 while FIG. 3C, at that same moment, shows a power period for the second motor 50.

As shown in FIG. 2A, motive fluid flowing through the rotor flow channels 28 enters the action chambers 31 and 32. Due to the geometry of the chambers (as discussed below) and the resultant forces, the motive fluid moves the rotor in a clockwise direction as seen in FIG. 2B. The action chamber 31 is sealed at one end by a rolling vane rod 71 which abuts an exterior surface 72 of the rotor 23 and a portion 74 of a rod recess 75.

At the other end of the action chamber 31, a seal 76 on a lobe 77 of the rotor 23 sealingly abuts an interior surface of the stator 21.

As shown in FIG. 2B, the rotor 23 has moved to a point near the end of a power period.

As shown in FIG. 2C, motive fluid starts exhausting at this point in the motor cycle through the exhaust ports 33.

As shown in FIG. 2D, the rolling vane rods 71 and seals 76 have sealed off the action chambers and motive fluids flowing thereinto will rotate the rotor 23 until the seals 76 again move past the exhaust ports 33.

The second motor 50 operates as does the first motor 20; but, as preferred, and as shown in FIGS. 3A–3D, the two motors are out of phase by 90° so that as one motor is exhausting motive fluid the other is providing power.

The seals 76 are, in one embodiment, made of polyethylethylketone (PEEK). The rolling vane rods 71 are also made from PEEK. The rotors (23, 25) and stators (21, 51) are preferably made from corrosion resistant materials such as stainless steel.

When a seal 76 in the first motor 20 rotates past an exhaust port 33, the motive fluid that caused the turning exits and flows downward, then through the channels 79, past the exhaust ports 63 and the flow channels 65.

It should be appreciated that although in the disclosed embodiment the drilling motor 310 comprises two motors 20, 50, with suitable adaptation, the drilling motor 310 may comprise only one motor 20 or 50.

Figure 5:
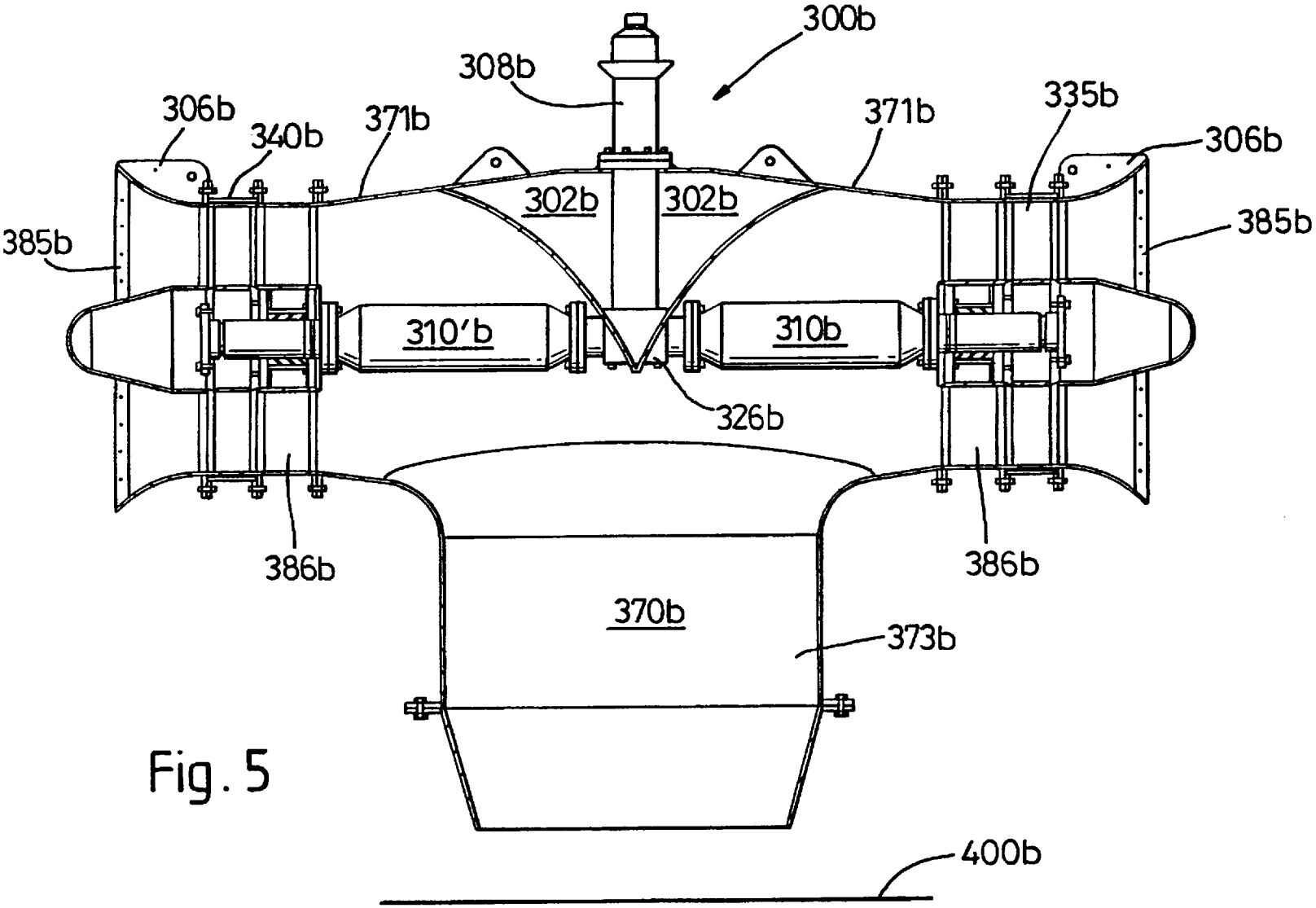
FIG. 5 shows a cross-sectional side view of a second embodiment of an excavation apparatus according to the present invention.

Referring now to FIG. 5, there is shown a second embodiment of an underwater excavation apparatus 300*b* according to the present invention. Like parts of the apparatus 300*a* are identified by numerals used to identify parts of the apparatus 300*a* of FIG. 1, except subscripted with "b" rather than "a".

The apparatus 300*b* differs from the apparatus 300*a* in that the shaft 342*a* and swivel 325*a* are replaced by a second motor 310'*b* and a T-coupling 326*b*. Thus in this embodiment the impellers 335*b*, 340*b* are driven by respective motors 310*b*, 310'*b*. In use, motive fluid is supplied to motors 310*b*, 310'*b* via fluid inlet 308*b* and T-coupling 326*b*.

Figure 6:
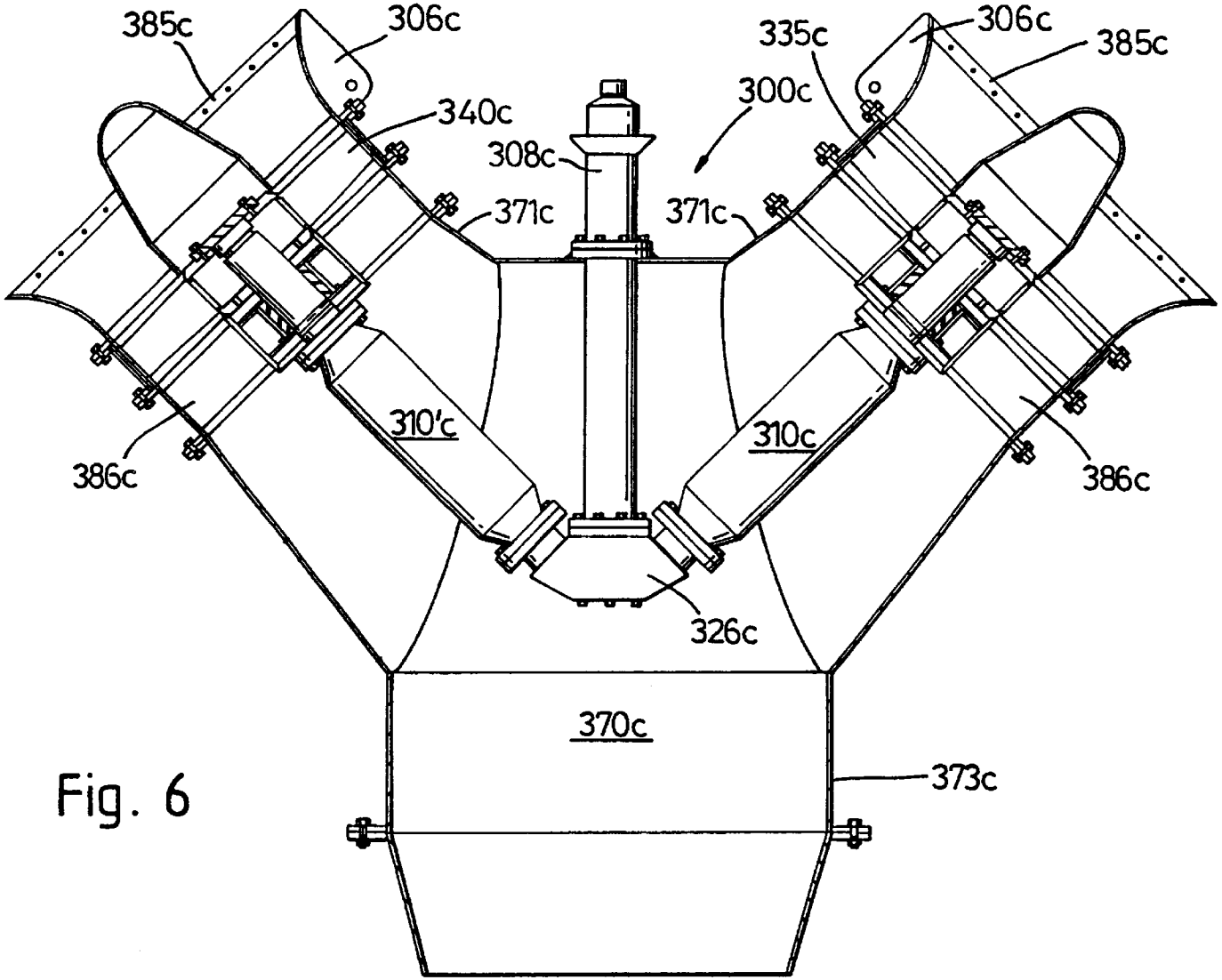
FIG. 6 shows a cross-sectional side view of a third embodiment of an excavation apparatus according to the present invention.

Referring now to FIG. 6, there is shown a second embodiment of an underwater excavation apparatus 300*c* according to the present invention. Like parts of the apparatus 300*b* are identified by numerals used to identify parts of the apparatus 300*b* of FIG. 5, except subscripted with "c" rather than "b".

The apparatus 300*c* differs from the apparatus 300*b* in that whereas in apparatus 300*b* the inlets 371*b* are horizontally opposed, in apparatus 300*c* the inlets are substantially symmetrically disposed around an axis extending from outlet 373*c*, such that the apparatus 300*c* is substantially "Y" shaped. In this embodiment there is, therefore, provided a Y-coupling 326*c*.

The embodiments of the invention hereinbefore described are given by way of example only, and are not meant to limit the scope of the invention in any way. It should be particularly appreciated that the drilling motor 310 is suitable for use in any of the disclosed embodiments.

What is claimed is:

1. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the driving means cause the impellers to be driven in contrary rotating directions.

2. An underwater excavation apparatus as claimed in claim 1, wherein there is provided one pair of inlets.

3. An underwater excavation apparatus as claim in claim 1, wherein the apparatus comprises a pair of horizontally opposed inlets communicating with a single outlet, the outlet being disposed vertically downwards substantially midway between the two inlets, in use, such that the excavation apparatus is substantially "T" shaped in profile.

4. An underwater excavation apparatus as claimed in claim 1, wherein the apparatus comprises a pair of inlets communicating with a single outlet, the inlets being substantially symmetrically disposed around an axis extending from the outlet, the outlet being disposed vertically downwards substantially midway between the two inlets, in use, such that the excavation apparatus is substantially "Y" shaped in profile.

5. An underwater excavation apparatus as claimed in claim 2, wherein the apparatus comprises a pair of horizontally opposed inlets communicating with a single outlet, the outlet being disposed vertically downwards substantially midway between the two inlets, in use, such that the excavation apparatus is substantially "T" shaped in profile.

6. An underwater excavation apparatus as claimed in claim 2, wherein the means for driving the impellers includes at least one drilling motor.

7. An underwater excavation apparatus as claimed in claim 1, wherein one of the impellers is provided within one of the inlets and another of the impellers is provided within another of the inlets.

8. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the means for driving the impellers includes at least one drilling motor.

9. An underwater excavation apparatus as claimed in claim 8, wherein the at least one drilling motor comprises a stator and a rotor rotatably mounted in the stator, the stator being provided with a rod recess and an exhaust port, the rotor being provided with a rotor channel and at least one channel, for conducting motive fluid from the rotor channel to a chamber between the rotor and the stator, the rod recess being provided with a rod which, in use, forms a seal between the stator and the rotor.

10. An underwater excavation apparatus as claimed in claim 9, wherein the rotor is provided with a seal for engagement with the stator.

11. An underwater excavation apparatus as claim in claim 10, wherein the seal is made from a material selected from the group consisting of plastics materials, polyethylethylketone, metal, copper alloys and stainless steel.

12. An underwater excavation apparatus as claimed in claim 9, wherein the rod is made from a material selected from the group consisting of plastics materials, polyethylethylketone, metal copper alloys and stainless steel.

13. An underwater excavation apparatus as claimed in claim 9, wherein the stator is provided with two rod recesses which are disposed opposite one another, and two exhaust ports which are disposed opposite one another, each of the rod recesses being provided with a respective rod, the rotor having two seals which are disposed opposite one another.

14. An underwater excavation apparatus as claimed in claim 10, wherein the rod is made from a material selected from the group consisting of plastics materials, polyethylethylketone, metal, copper alloys and stainless steel.

15. An underwater excavation apparatus as claimed in claim 10, wherein the stator is provided with two rod recesses which are disposed opposite one another, and two exhaust ports which are disposed opposite one another, each of the rod recesses being provided with a respective rod, the rotor having two seals which are disposed opposite one another.

16. An underwater excavation apparatus as claimed in claim 11, wherein the rod is made from a material selected from the group consisting of plastics materials, polyethylethylketone, metal, copper alloys and stainless steel.

17. An underwater excavation apparatus as claimed in claim 11, wherein the stator is provided with two rod recesses which are disposed opposite one another, and two exhaust ports which are disposed opposite one another, each of the rod recesses being provided with a respective rod, the rotor having two seals which are disposed opposite one another.

18. An underwater excavation apparatus as claimed in claim 12, wherein the stator is provided with two rod recesses which are disposed opposite one another, and two exhaust ports which are disposed opposite one another, each of the rod recesses being provided with a respective rod, the rotor having two seals which are disposed opposite one another.

19. An underwater excavation apparatus as claimed in claim 8, wherein the at least one drilling motor comprises two drilling motors arranged with their respective rotors connected together each motor comprising a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

20. An underwater excavation apparatus as claimed in claim 19, wherein the drilling motors are connected in parallel or in series.

21. An underwater excavation apparatus as claimed in claim 19, wherein the drilling motors are arranged so that, in use, one drilling motor operates out of phase with the other.

22. An underwater excavation apparatus as claimed in claim 20, wherein the drilling motors are arranged so that, in use, one drilling motor operates out of phase with the other.

23. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the apparatus comprises a pair of horizontally opposed inlets communicating with a single outlet, the outlet being disposed vertically downwards substantially midway between the two inlets, in use, such that the excavation apparatus is substantially "T" shaped in profile.

24. An underwater excavation apparatus as claimed in claim 23, wherein the means for driving the impellers includes at least one drilling motor.

25. An underwater excavation apparatus as claimed in claim 23, wherein at least one impeller is provided within each outlet.

26. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein one of the impellers is provided within one of the inlets and another of the impellers is provided within another of the inlets.

27. An underwater excavation apparatus as claimed in claim 26, wherein there is provided one pair of inlets.

28. An underwater excavation apparatus as claimed in claim 26, wherein the apparatus comprises a pair of horizontally opposed inlets communicating with a single outlet, the outlet being disposed vertically downwards substantially midway between the two inlets, in use, such that the excavation apparatus is substantially "T" shaped in profile.

29. An underwater excavation apparatus as claimed in claim 26, wherein the apparatus comprises a pair of inlets communicating with a single outlet, the inlets being substantially symmetrically disposed around an axis extending from the outlet, the outlet being disposed vertically downwards substantially midway between the two inlets, in use, such that the excavation apparatus is substantially "Y" shaped in profile.

30. An underwater excavation apparatus as claimed in claim 26, wherein the means for driving the impellers includes at least one drilling motor.

31. An underwater excavation apparatus as claimed in claim 26, wherein the means for driving the impellers includes at least one drilling motor.

32. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the apparatus comprises a pair of inlets communicating with a single outlet, the inlets being substantially symmetrically disposed around an axis extending from the outlet, the outlet being disposed vertically downwards substantially midway between the two inlets, in use, such that the excavation apparatus is substantially "Y" shaped in profile.

33. An underwater excavation apparatus as claimed in claim 32, wherein the means for driving the impellers includes at least one drilling motor.

34. An underwater excavation apparatus as claimed in claim 32, wherein the inlets are each inclined substantially 45° from the axis extending from the outlet.

35. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the impellers are driven by means of a gearbox.

36. An underwater excavation apparatus as claimed in claim 35, wherein the reactive torque upon the said drive body is utilized, at least one impeller is connected to an output shaft of said motor, while at least one other impeller is connected to the said drive body.

37. An underwater excavation apparatus comprising a hollow body having one pair of inlets and at least one outlet, at least one pair of impellers rotatably mounted in the hollow body, and means for driving the impellers, wherein the pair of inlets are substantially symmetrically disposed around an axis extending from the at least one outlet, wherein the means for driving the impellers includes at least one drilling motor.

38. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the impellers are driven by a pair of motors operating in opposite directions.

39. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the underwater excavation apparatus further comprises an agitator device having mechanical disturbance means and fluid flow disturbance means.

40. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein in use the underwater excavation apparatus is suspended from a surface vessel or mounted upon a sled.

41. An underwater excavation apparatus comprising a hollow body having at least one pair of inlets and at least one outlet, at least one pair of impellers rotatably mounted in the hollow body, and means for driving the impellers, wherein the pair of inlets are substantially symmetrically disposed around an axis extending from the at least one outlet, and wherein the impellers are driven by means of exploitation of the opposing reactive torque on a drive body of at least one motor.

* * * * *